US005357676A

United States Patent [19]

Bannett

[11] Patent Number: 5,357,676

[45] Date of Patent: Oct. 25, 1994

[54] NAIL BLUNT CLIPPER

[76] Inventor: Ronald Bannett, 4530 N. Hiatus Rd., Unit #109, Sunrise, Fla. 33351

[21] Appl. No.: 60,024

[22] Filed: May 10, 1993

[51] Int. Cl.[5] ..... A45D 29/02; A45D 29/06

[52] U.S. Cl. ..... 30/28; 30/26

[58] Field of Search ..... 30/26, 28, 175, 75.4, 30/75.5

[56] References Cited

U.S. PATENT DOCUMENTS

| | | | |
|---|---|---|---|
| 1,085,569 | 1/1914 | Casse | 30/28 |
| 1,363,164 | 12/1920 | Oesterwitz | 30/28 |
| 2,999,506 | 9/1961 | Hunt | 30/28 |
| 3,937,234 | 2/1976 | Loda | 30/28 |
| 4,731,927 | 3/1988 | Wilson | 30/28 |

*Primary Examiner*—Richard K. Seidel
*Assistant Examiner*—Paul M. Hryrana, Sr
*Attorney, Agent, or Firm*—Malin, Haley, DiMaggio & Crosby

[57] ABSTRACT

A fingernail clipper for cutting long natural or artificial nails in a single stroke, comprising an upper tine, a lower tine, an actuator handle, and a sliding joint guide member, wherein the upper and lower tines are connected at one end, having apertures at the opposite end to accommodate the sliding joint guide member, and a closeable nail receiving chamber. The actuator handle is attached to the upper tine to induce a cantilevered load when actuated, vertically shearing an entrapped fingernail.

4 Claims, 2 Drawing Sheets

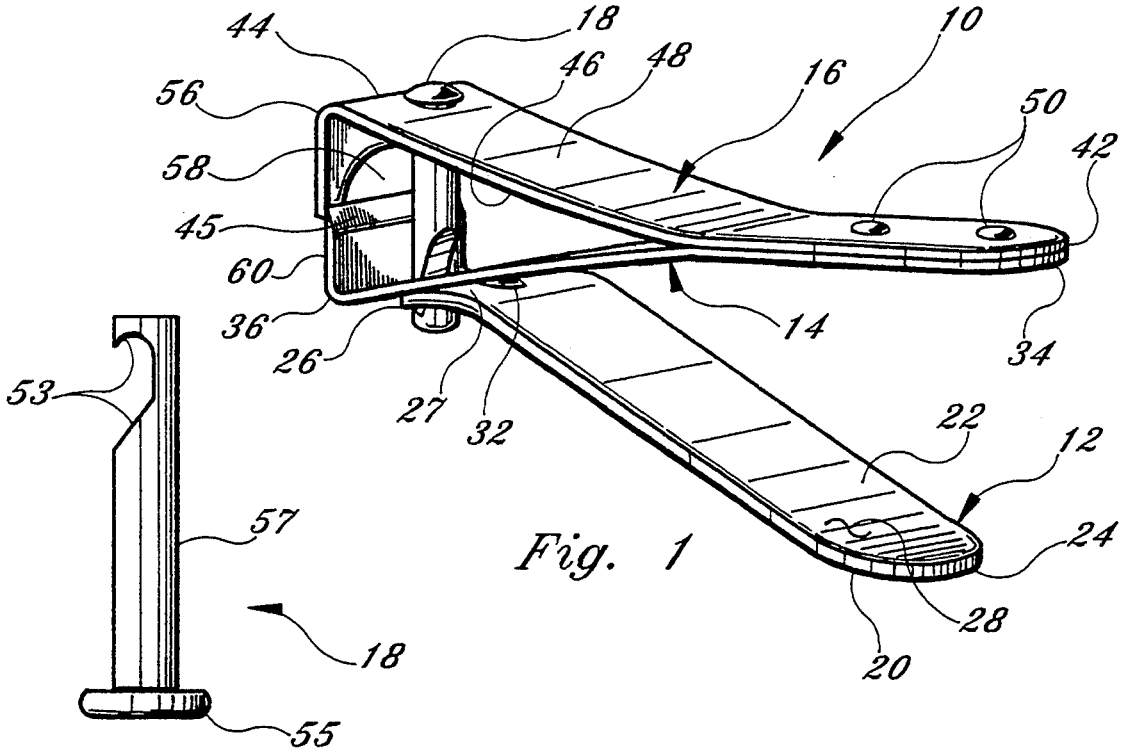
Fig. 1
Fig. 2
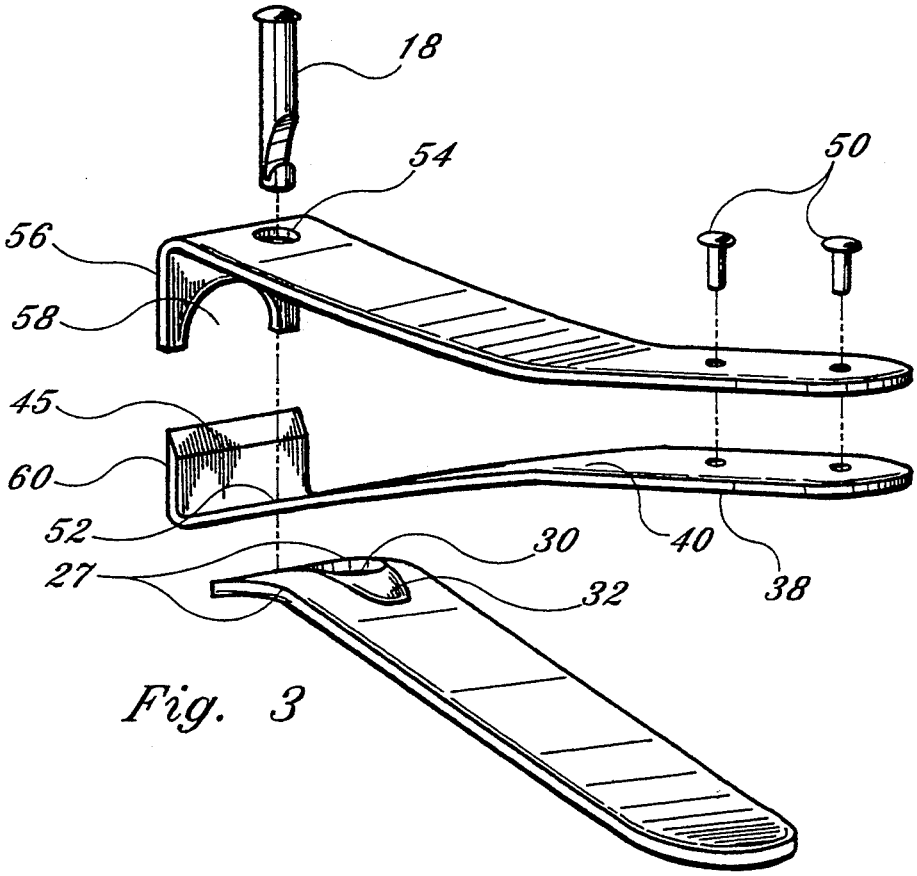
Fig. 3

NAIL BLUNT CLIPPER

BACKGROUND OF THE INVENTION

1. Field of the Invention

The present invention relates generally to finger nail clippers, more specifically, to clippers for cutting long natural or artificial nails in a single stroke.

2. Description of the Background Art

It has long been desired to cut long natural and artificial fingernails in a single stroke without chipping or cracking the nail and to eliminate the time, mess, and imprecision associated with the standard type of shear nail cutter. Present single stroke nail cutters are of the type disclosed in U.S. Pat. No. 4,856,190, issued to Reiswig on Aug. 15, 1989, and U.S. Pat. No. 3,838,507, issued to Clark on Oct. 1, 1974.

Both of the aforementioned patents teach the use of a planar nail cutter, in which a shearing blade is actuated by squeezing a pair of pivotally connected handles. This configuration requires a multitude of precision machined components in order to effectuate its operation. These planar nail cutters comprise a removable blade which is releasably connected to a handle for reciprocating movement in a slot-type passageway by a push-/pull link, the link being pivotally connected to a handle by a pin. The clipper further provides a tension spring mechanism to provide the force necessary to keep the clipper assembly in an open and "armed" position. The disadvantages of such an assembly is the unnecessary complexity required in its fabrication, the necessity for maintenance and the tendency of the blade to fall out of alignment. Therefore a need exists for a simple single-stroke nail cutter which accomplishes the same desired results as the prior art but through simple and efficient design which does not require expensive machining and extensive assembly procedures.

SUMMARY OF THE INVENTION

The instant invention provides a single stroke nail clipper useful for cutting long natural or artificial nails, comprising efficient design and simplicity of manufacture. The nail clipper is comprised of four (4) components: an upper tins, a lower tins, an actuator handle, and sliding joint guide member. The actuator handle is a machined or cast elongated planar member having a top and bottom surface, and a proximal and distal end. Near the proximal end, there is disposed a slight twist in profile to facilitate grasping, and near the distal end, an aperture for attachment to the other components in a sliding joint. A small male protrusion extends normal to the bottom surface adjacent to the aperture. The upper and lower tines are machined or cast elongated planar members having proximal and distal ends, and top and bottom surfaces. Both have an aperture near their respective distal ends for accommodating the sliding joint guide member, and an angular profile such that when fastened at their respective proximal ends, and attached to the actuator handle via the pivot joint guide member, the resulting assembly is a bifurcated nail clipper. At the distal end of the lower tine, there is provided an end flange with an aperture, such as a crescent shape, normal therethrough for accepting and reinforcing the nail to be clipped. The upper tins has a knife-edge tapered end flange at its distal end which functions as a shearing means.

Cutting is effectuated by inserting a portion of a nail to be trimmed through the crescent shaped aperture in the end flange of the lower tine, and thereafter exerting pressure on the handle while simultaneously gripping the entire clipper assembly. The handle induces a cantilevered load on the upper tine in the area near the joint guide member, the sliding joint restricts the motion of the upper tins to vertical translation, thus forcing the upper tine from a first position down and parallel to the lower tins, vertically shearing a portion of the entrapped fingernail in one smooth cut without bending the nail as it is forced normal to the plane of the knife edge tapered end flange at a second position. Upon unloading the actuator handle, the residual bending strain energy in the upper tine forces the cutter to return to its open position. This configuration thus makes optimum use of its constituent component's mechanical properties and geometric orientation to enable its reciprocating motion without resorting to complex and expensive spring loaded mechanical systems.

It is an object of the present invention to provide a clipper capable of safely clipping a fingernail in a single stroke without causing damage.

It is a further object of the invention to provide a single stroke nail clipper having minimal moving parts for simple, efficient, and economic design which is readily amenable to high rate and low cost manufacture.

It is still a further object of the invention to provide a single stroke nail clipper that is easy to operate, and compact and lightweight for easy storage when not in use.

These and other objects will become apparent when the aforementioned is addressed in conjunction with the hereinafter detailed component description and drawings.

BRIEF DESCRIPTION OF THE DRAWINGS

FIG. 1 is a perspective view of the preferred embodiment of theclipper assembly;

FIG. 2 is an elevational view of the guide member;

FIG. 3 is an exploded view of the preferred embodiment of the clipper assembly;

DETAILED DESCRIPTION OF THE PREFERRED EMBODIMENT

Figure 4:
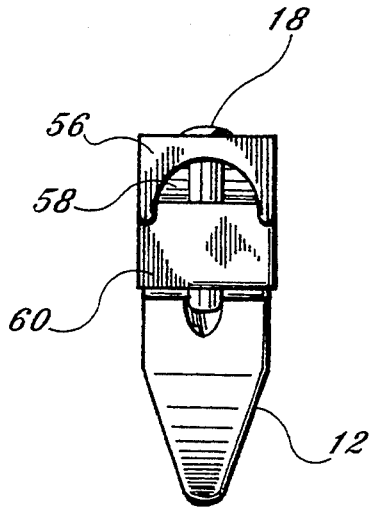
FIG. 4 is a front elevational view of the preferred embodiment of the clipper assembly.
Figure 5:
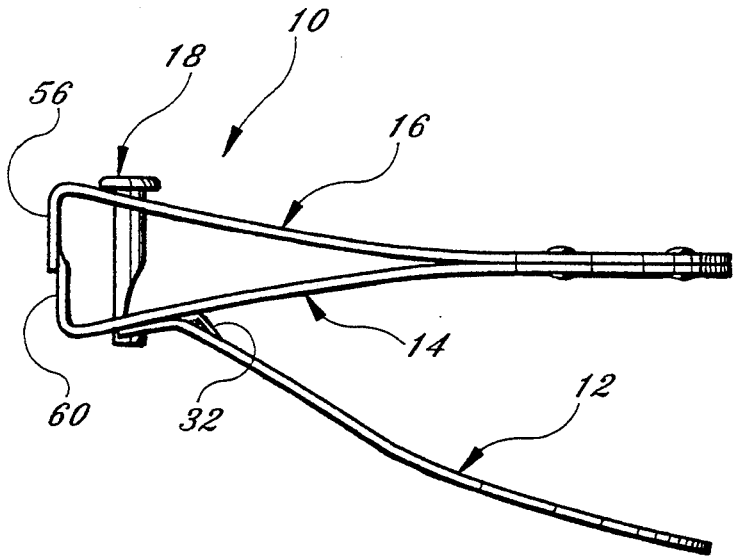
FIG. 5 is a side elevational view of the preferred embodiment of the clipper assembly.

With reference to the views of the drawing, FIG. 1 depicts a bifurcated nail blunt clipper 10 comprising an upper tine 14; a lower tine 16; an actuator handle 12; and guide 18.

The actuator handle 12 is a machined or cast elongated planar member having a top surface 20, a bottom surface 22, a proximal end 24 and distal end 26. A slight twist in profile 28 is provided near proximal end 24 to facilitate holding. The distal end 26 has a flange 27 disposed at an obtuse angle to the elongated portion and an aperture 30 through which guide 18 provides attachment to the upper and lower tines 14 and 16 respectively in a sliding joint. A male protrusion 32 is disposed adjacent to the aperture 30 and extends normal to bottom surface 22 for applying a bearing cantilevered load on upper tine 14 upon the actuation of handle 12.

The upper tine 14 is a machined or cast generally elongated planar member having a proximal end 34, a distal end 36, a top surface 38 and a bottom surface 40. The lower tine 16 is a machined or cast generally elongated planar member having a proximal end 42, a distal end 44, a top surface 46, and a bottom surface 48. Each tine has an angular profile, so that when the clipper is fully assembled, the resulting structure is a bifurcation oriented in a first position. The upper and lower tines, 14 and 16 respectively, are fastened together at their respective proximal ends 34 and 42 via fastening means such as a pair of rivets 50. Tines 14 and 16 are additionally tied together in a sliding joint by inserting guide member 18 through apertures 52 and 54 defined in both tines respectively. The lower tine 16 has an end flange 56 at its distal end 44, which further comprises a cut-out portion such as a crescent shape 58 defined normal therethrough, thereby defining the lower periphery of a closeable chamber for accepting and reinforcing the surface of a portion of the nail to be clipped. The upper tine 14 has end flange 60 at its distal end 36 which is tapered to a knife-edge 45 to provide a suitable shearing surface and which defines the upper periphery of the closeable chamber.

The sliding joint guide member 18 is an elongated cylindrical structure having a hook portion 53 and a head portion 55 separated by a body portion 57, which ties together the actuator handle 12, upper tine 14, and lower tine 16 respectively in sliding joint.

Clipper 10 is assembled by riveting upper and lower tines 14 and 16 at their proximal ends 34 and 42 respectively. Guide member 18 is subsequently inserted through apertures 54 and 52 in lower and upper tines 16 and 14 respectively exposing hook portion 53. Handle 12 is then pivotally attached to guide member 18 at hook portion 53 with male protrusion 32 bearing on upper tine 14 top surface 38 when clipper 10 is in use, and which may be pivoted to reverse orientation when desired for storage.

Figure 6:
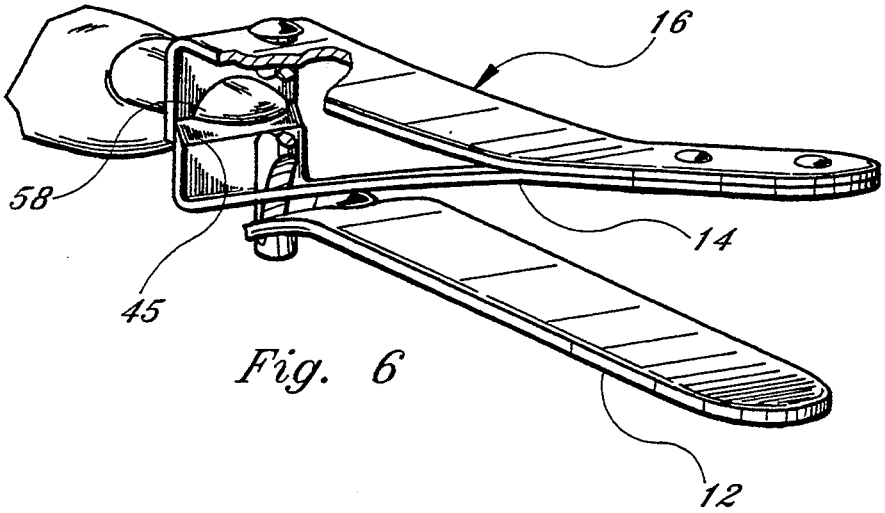
FIG. 6 is a perspective view with a partial cut-away of the preferred embodiment of the clipper assembly partially actuated to illustrate use.

Single stroke nail cutting is effectuated by placing a portion of the fingernail through and up against the crescent shaped cut out 58 while the clipper is in a first position, as shown in FIG. 6. The end flanges 56, 60 may be positioned so that they are vertically oriented for a straight cut or angled for more of a curved cut. Hand pressure on the handle 12 induces a cantilevered load on the upper tine 14 via the male protrusion 32 thereby causing upper tine 14 to bend. Guide 18 restricts the motion of the upper tine 14 to vertical translation, thus urging upper tine 14 to slide downward and parallel to the lower tine end flange 56. As upper tine 14 is biased, a portion of the nail is sheared off vertically at a second position. Releasing pressure on the handle 12 causes the residual bending strain energy in the upper tine 14 to restore the clipper assembly 10 to its first position.

The invention described herein has been shown in what is considered the most practical embodiment. It is anticipated that departures may be made therefrom within the scope of the invention and that obvious modifications will be implemented by a person skilled in the art.

What I claim is:

1. An apparatus for cutting a nail comprising:

an upper tine comprising an elongated, planar, angled body portion, said upper tine having a proximal end and a distal end, said upper tine having a top surface and a bottom surface, said upper tine further having an aperture defined normal therethrough adjacent said distal end;

a lower tine comprising an elongated, planar, angled body portion, said lower tine having a proximal end and a distal end, said lower tine having a top surface and a bottom surface, said lower tine further having an aperture defined normal therethrough adjacent said lower tine distal end, said lower tine rigidly attached to said upper tine at said upper and lower tine proximal ends, said upper tine and said lower tine diverging from said upper and lower tine proximal ends, said upper and lower tine apertures being aligned;

means for cutting said nail disposed at the distal end of each of said upper and lower tines, respectively, said means for cutting comprising a first flange portion integrally joined to said upper tine distal end and a second flange portion integrally joined to said lower tine distal end, said first flange extending downwardly from said bottom surface of said upper tine, said second flanges extending upwardly from said top surface of said lower tine, said first flange and said second flange forming a crescent-shaped nail receiving aperture; and means for reciprocating said upper and lower tines between a first position and a second position attached to each of said upper and lower tines, respectively, said first flange and said second flange overlapping and being slidably engaged in at least said second position.

2. The apparatus of claim 1, wherein said means for reciprocating comprises:

a handle having a proximal end and a distal end, said handle having a top surface and a bottom surface, said handle having an aperture defined at said handle distal end, said handle aperture being in alignment with said upper tine aperture and said lower tine aperture, said handle having a protrusion at said distal end extending outward from said bottom surface of said handle such that said protrusion engages said upper tine top surface, said handle having an angled flange portion defined by said handle distal end, said angled flange portion disposed adjacent to, and flush against, said upper tine; and a cylindrical guide member communicating with said upper tine, said lower tine, and said handle in a sliding joint, said guide member having a hooked top end, said guide member extending through each of said upper tine aperture, said lower tine aperture and said handle aperture, respectively, said hooked top end pivotally connecting said handle flange portion to said upper tine.

3. The apparatus of claim 2, wherein said handle further comprises a slight twist in profile intermediate said proximal and distal ends of said handle.

4. An apparatus for cutting a nail, comprising:

an upper tine comprising an elongated, planar, angled body portion, said upper tine having a proximal end and a distal end, said upper tine having a top surface and a bottom surface, said upper tine further having an aperture defined normal therethrough adjacent said distal end;

a lower tine comprising an elongated, planar, angled body portion, said lower tine having a proximal end and a distal end, said lower tine having a top surface and a bottom surface, said lower tine further having an aperture defined normal therethrough adjacent said lower tine distal end, said lower tine rigidly attached to said upper tine at said upper and lower tine proximal ends, said upper tine and said lower tine diverging from said upper and lower tine proximal ends, said upper and lower tine apertures being aligned;

means for cutting said nail disposed at the distal end of each of said upper and lower tines, respectively, said means for cutting comprising a first flange portion integrally joined to said upper tine distal end and extending from said bottom surface of said upper tine and a second flange portion integrally joined to said lower tine distal end and extending from said top surface of said lower tine, said first flange portion having a tapered edge to provide a shearing surface, said second flange portion defining a crescent shaped surface, said first flange and said second flange forming a crescent-shaped nail receiving aperture;

a handle for reciprocating said upper tine and said lower tine between a first, open position and a second, closed position, said handle having a proximal end and a distal end, said handle having a top surface and a bottom surface, said handle further having an aperture near said handle distal end in alignment with said upper tine aperture and said lower tine aperture, said handle further having a protrusion near said handle distal end extending outward from said bottom surface of said handle, said handle distal end further defining an angled flange portion disposed adjacent to, and flush against, said upper tine, said first, open position defining for said crescent shaped nail receiving aperture and said second position defined by engaging said tapered edge and said crescent shaped surface, said first flange and said second flange overlapping and being slidably engaged in said second position; and a cylindrical guide member for mechanically communicating said upper tine, said lower tine and said handle in a sliding joint to restrict said upper tine and said lower tine to vertical movement, said guide member having a hooked top end, said guide member extending through each of said upper tine aperture, said lower tine aperture and said handle aperture, respectively, said hooked top end pivotally connecting said handle flange portion to said upper tine.

* * * * *